US006116339A

United States Patent [19]

Milne et al.

[11] Patent Number: 6,116,339

[45] Date of Patent: Sep. 12, 2000

[54] RUNNING AND SETTING TOOL FOR PACKERS

[75] Inventors: John Robert William Milne, Bucksburn, United Kingdom; Chris Caton, The Woodlands, Tex.; George Milne Lorgen, Peterhead, United Kingdom

[73] Assignee: Baker Hughes Incorporated, Houston, Tex.

[21] Appl. No.: 08/943,721

[22] Filed: Oct. 3, 1997

[30] Foreign Application Priority Data

Oct. 8, 1996 [GB] United Kingdom ..... 9620945

[51] Int. Cl.[7] ..... E21B 23/00

[52] U.S. Cl. ..... 166/125; 166/123; 166/181; 166/237

[58] Field of Search ..... 166/125, 123, 166/181, 242.7, 237

[56] References Cited

U.S. PATENT DOCUMENTS

| | | |
|---|---|---|
| 803,450 | 10/1905 | Stegner . |
| 808,378 | 12/1905 | Johnston . |
| 1,457,139 | 5/1923 | Bell et al. . |
| 1,580,352 | 4/1926 | Ventresca . |
| 1,619,254 | 3/1927 | Hart . |
| 1,621,947 | 3/1927 | Moore . |
| 1,638,494 | 8/1927 | Lewis et al. . |
| 1,712,898 | 5/1929 | Newkirk . |
| 1,719,584 | 7/1929 | Bonner . |
| 1,728,136 | 9/1929 | Power . |
| 1,779,123 | 10/1930 | Gates . |
| 1,794,652 | 3/1931 | Stone . |
| 1,815,462 | 7/1931 | Denny . |
| 1,823,340 | 9/1931 | Vance . |
| 1,917,135 | 7/1933 | Littell . |
| 2,141,987 | 12/1938 | Jones . |
| 2,290,409 | 7/1942 | Cuthill . |
| 2,507,127 | 5/1950 | True . |
| 2,732,901 | 1/1956 | Davis . |
| 2,806,534 | 9/1957 | Potts . |
| 3,199,906 | 8/1965 | Chenoweth . |
| 3,262,501 | 7/1966 | Winger . |
| 3,265,431 | 8/1966 | Burner . |
| 3,638,989 | 2/1972 | Sandquist . |
| 4,181,344 | 1/1980 | Gazda . |
| 4,273,372 | 6/1981 | Sheshtawy . |
| 4,443,130 | 4/1984 | Hall . |
| 4,616,721 | 10/1986 | Furse . |
| 4,688,634 | 8/1987 | Lustig et al. . |
| 4,832,129 | 5/1989 | Sproul et al. . |
| 5,242,201 | 9/1993 | Beeman . |
| 5,343,954 | 9/1994 | Bohlen et al. . |
| 5,718,291 | 2/1998 | Lorgen et al. ..... 166/377 |

FOREIGN PATENT DOCUMENTS

| | | |
|---|---|---|
| 0 187 408 A1 | 9/1981 | European Pat. Off. . |
| 0 232 183 A2 | 2/1987 | European Pat. Off. . |
| 213798 | 3/1987 | European Pat. Off. . |
| 2 244 736 | 12/1991 | United Kingdom . |

OTHER PUBLICATIONS

Baker Oil Tools, Production Packers Technical Unit, Baker Retrieva–D Lok–Set Packer Size 46B and 46C, Product No. 646–16, Dec. 1975, 1–9.

Baker Oil Tools, Production Packers Technical Unit, Baker Size 49 Retrieva–D, Retrieva–DA Lok–Set Packers and Retrieving Tools, Product Nos. 646–16, 646–17, 646–18, 646–22 & 646–25, Dec. 1975, 1–3, 7, 14–20.

*Primary Examiner*—David Bagnell
*Assistant Examiner*—Chi H. Kang
*Attorney, Agent, or Firm*—Duane, Morris & Heckscher LLP

[57] ABSTRACT

A running/setting tool for packers is disclosed which can release in several different ways. The tool can be pumped through for normal release. The tool may be hydraulically released by dropping and pumping a ball to a seat and subsequent pressurizing. A frangible member is provided so that if circulation is impeded, it can be established by breaking the frangible member to allow a ball to be pumped to a seat. Finally, a shear release technique is provided which allows release by breaking a shear pin or shear ring or other frangible member, which unsupports collets to allow for removal. A support shoulder is provided on the tool to prevent the collets from becoming stressed on the trip out of the hole if the tool encounters a collar or other internal obstruction.

17 Claims, 12 Drawing Sheets

RUNNING AND SETTING TOOL FOR PACKERS

FIELD OF THE INVENTION

The field of this invention relates to a running and setting tool which is particularly usable for packers. It features multiple releasing techniques.

BACKGROUND OF THE INVENTION

Running tools for packers have in the past primarily allowed for a single mode of release. This has generally been accomplished by picking up or setting down and breaking a frangible member, such as a shear pin, to effectuate the release. Other designs used in the past have added to the shear release technique by providing a mechanism for hydraulic release by virtue of dropping a ball against a seat. These designs were workable if pumping through the tubing was possible and there was no pluggage downhole to preclude pumping the ball down to the seat. However, in those designs, should the tubing be obstructed or include a wireline device, the technique of hydraulic release became unworkable. Designs have been developed for fishing tools where a release is possible by virtue of backpressure created by flow through an orifice. An example of such a design for a fishing tool is U.S. Pat. No. 5,242,201. In this fishing tool, latching occurs by setting down weight, and release occurs by setting down weight coupled with a flow through an orifice which creates backpressure to desupport collets so that disengagement from a fishing neck can occur.

What has been lacking in prior running and setting tools for packers is a plurality of reliable release techniques. Thus, one of the objects of the present invention is to provide multiple techniques for release from the packer after set. Another objective of the invention is to provide the necessary internal supports in the tool so that upon removal of the running/setting tool from the wellbore, the latch mechanism does not get inadvertently engaged and damaged, as was possible in some of the prior designs. Another objective of the invention is to provide a mechanism to allow the pumping of a ball down to a seat, even if normal circulation is impeded by a downhole obstruction.

SUMMARY OF THE INVENTION

A running/setting tool for packers is disclosed which can release in several different ways. The tool can be pumped through for normal release. The tool may be hydraulically released by dropping and pumping a ball to a seat and subsequent pressurizing. A frangible member is provided so that if circulation is impeded, it can be established by breaking the frangible member to allow a ball to be pumped to a seat. Finally, a shear release technique is provided which allows release by breaking a shear pin or shear ring or other frangible member, which unsupports collets to allow for removal. A support shoulder is provided on the tool to prevent the collets from becoming stressed on the trip out of the hole if the tool encounters a collar or other internal obstruction.

DETAILED DESCRIPTION OF THE PREFERRED EMBODIMENT

Figure 1A:
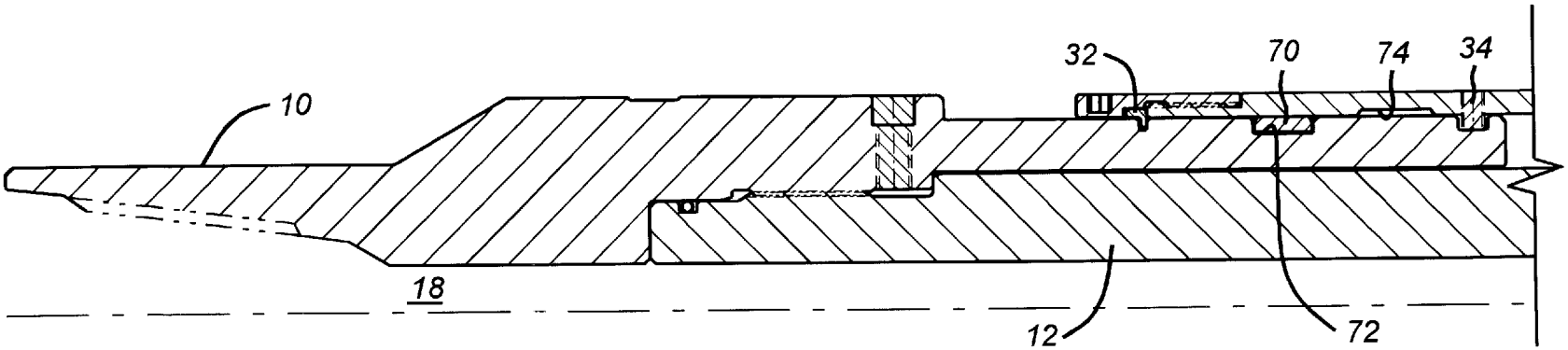
FIGS. 1*a–d* are a sectional elevational view of the tool in the run-in position.

The tool has a top sub 10, a body 12, and a bottom sub 14. At the lower end of bottom sub 14 is thread 16. What would normally be attached to thread 16 but is not shown in the drawing is the assembly that is connectable to a downhole packer so that it could be set hydraulically by pressure applied through passage 18. The annular space 20 between the packer sleeve 22 and the body 12 is sealed by opposed chevron seals 24 so that if necessary for setting the packer, the annular space 20 can also be pressurized through passage 18. These details have been omitted to focus on the latching and releasing aspects of the tool depicted. The type of packer used and the actual setting mechanism for such a packer are outside the purview of the invention.

Figure 1B:
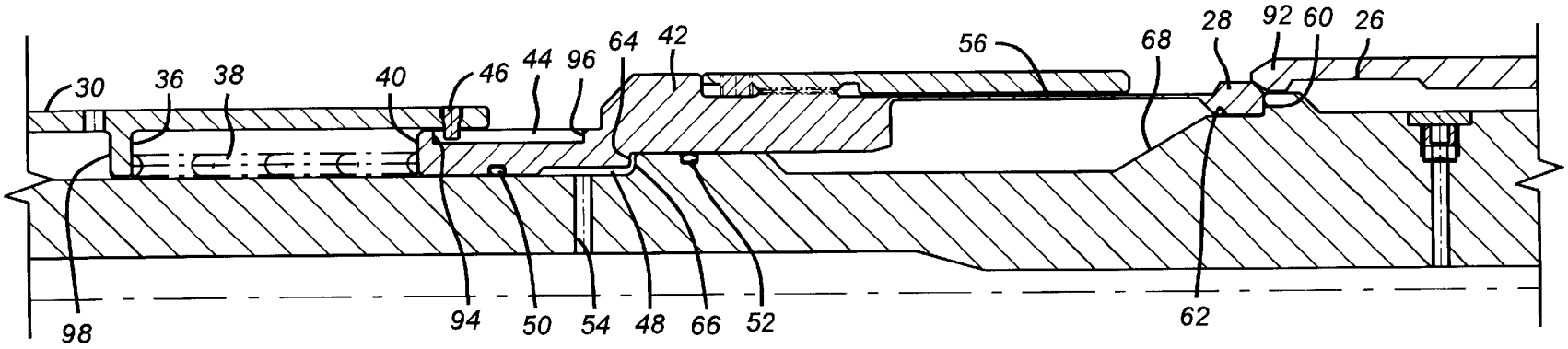
Figure 3B:
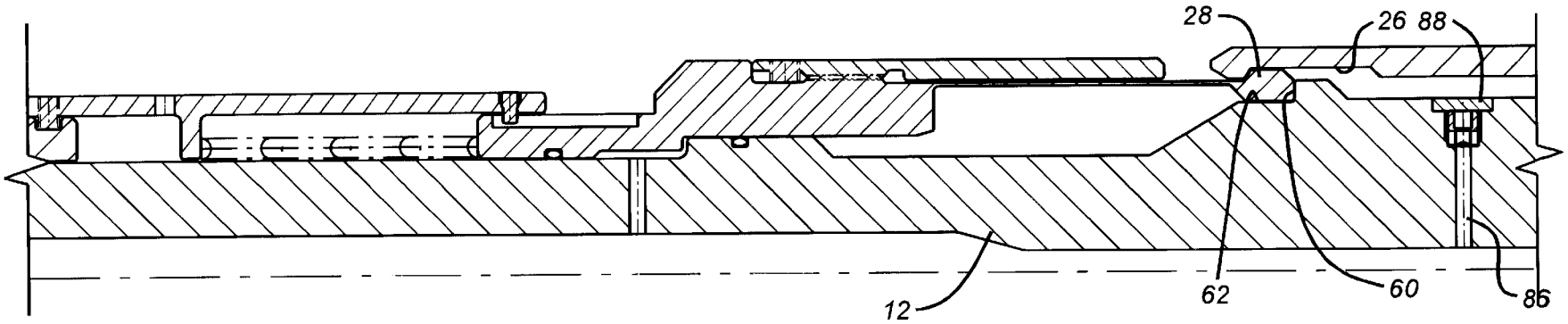

The packer sleeve 22 has an internal groove 26 which is illustrated in the drawings in FIG. 1*b*. Ultimately, the collets 28 will engage groove 26, as shown in FIG. 3*b*, to secure the body 12 to the sleeve 22 which is attached to the packer (not shown). In order to understand how the body 12 through collets 28 is latched to groove 26, it is necessary to understand that the top sub 10 is connected to an outer sleeve 30 by one or more frangible devices such as a shear ring 32 or a shear pin or pins 34. The circumstances of the application, which dictate the load requirements prior to a release between sleeve 30 and top sub 10, will dictate the design and quantities of shear ring 32 or pins 34 in whatever combination they may be employed. The sleeve 30 has an internal shoulder 36 on which abuts a spring 38. The other end of spring 38 rests on surface 40 of collet ring 42. Collet ring 42 has a longitudinal groove 44 in which rides pin 46.

A cavity 48 is formed between collet ring 42 and body 12. Cavity 48 has seals 50 and 52 at its upper and lower ends, respectively. Passage 54 connects passage 18 to cavity 48.

Collet ring 42 has a series of collets 28 extending therefrom on elongated members or fingers 56. In essence, the elongated members 56 act like fingers which allow for flexibility for radial movement of the collets 28, as indicated by comparing FIGS. 1*b* and 2*b*. An external sleeve 58 acts as a guide to the collets 28 to retain them in the run-in position shown in FIG. 1*b*, where the collets 28 rest on surfaces 60 and 62 which are at 90° to each other on body 12.

Collet ring 42 has a shoulder 64 which can be engaged by shoulder 66 on certain conditions during removal of the tool, as will be described below.

Figure 2A:
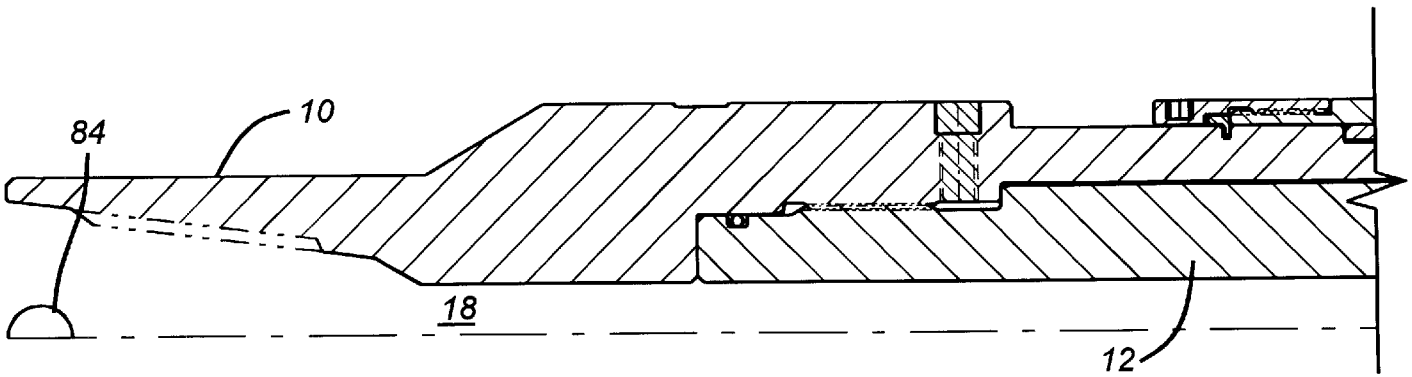
FIGS. 2*a–d* depict the same tool in the setting position.
Figure 2B:
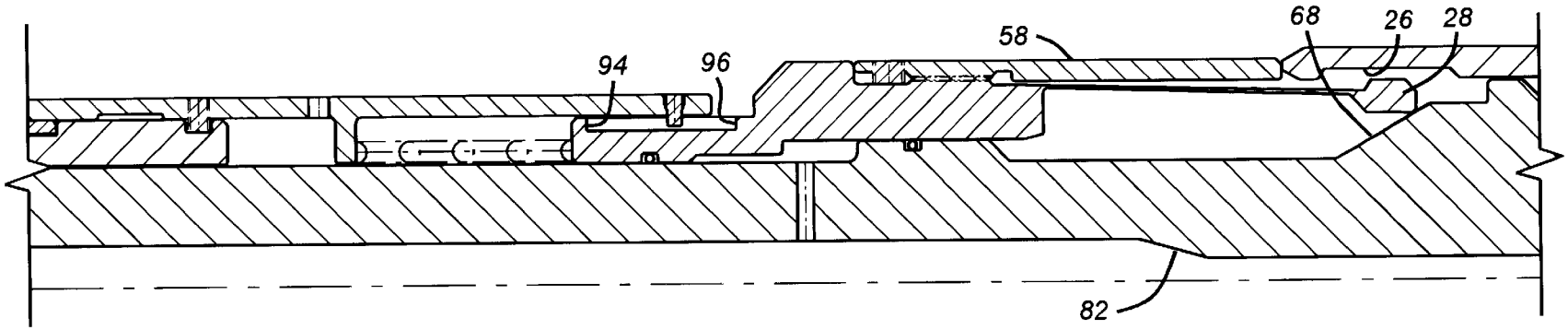
Figure 1C:
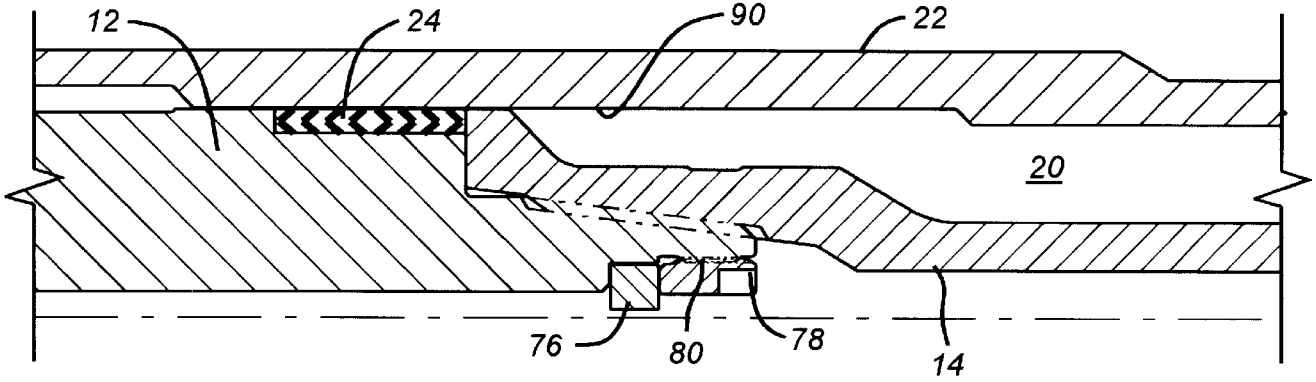
Figure 2C:
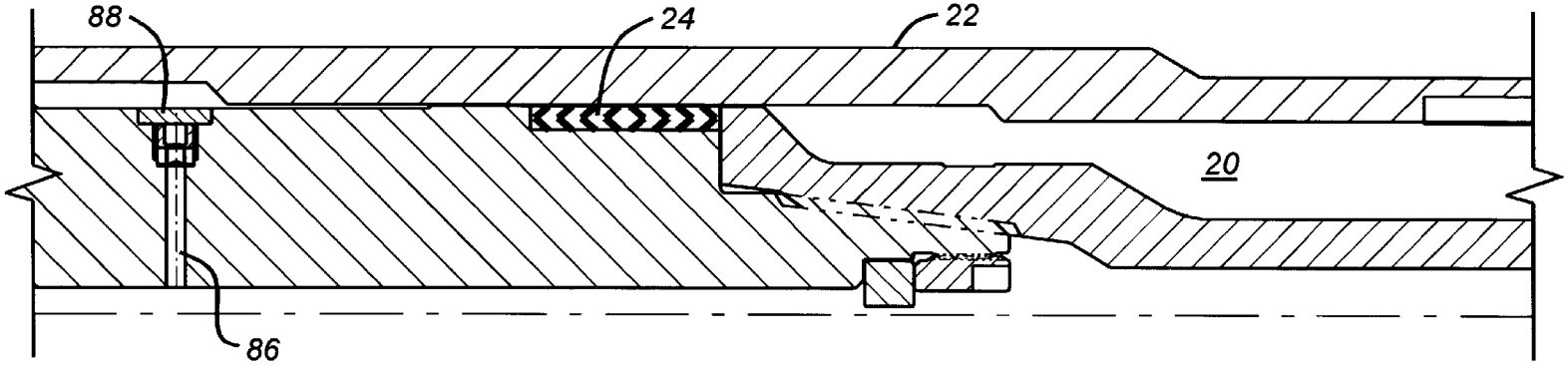
Figure 1D:
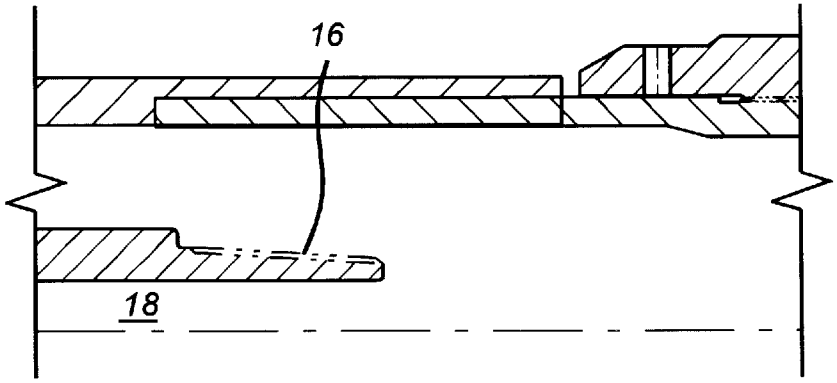
Figure 2D:
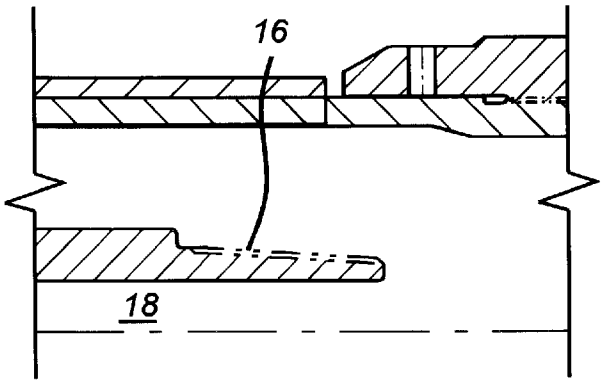
Figure 3A:
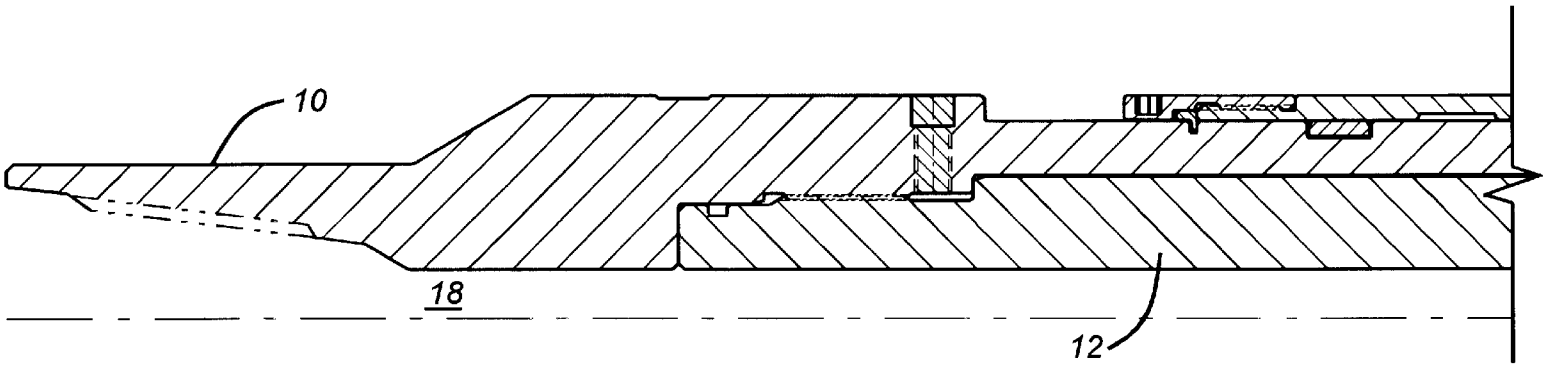
FIGS. 3*a–d* depict the same tool in the set position.

Body 12 has a tapered surface 68 adjacent surface 62 to allow the collets 28 to retreat radially inwardly, as shown in FIG. 2*b*.

Top sub 10 has a lock ring 70 which is initially held in groove 72 by virtue of sleeve 30. Sleeve 30 also has a groove 74. When groove 74 aligns with lock ring 70, lock ring 70 spreads outwardly into groove 74 to lock the sleeve 30 to top sub 10 for an emergency release, as will be explained below.

Body 12 has an orifice ring 76. Ring 76 is placed in the flowpath 18 to provide a constriction to allow backpressure to be created on flow therethrough. Ring 78 secures the orifice ring 76 to body 12 by virtue of thread 80.

Taper 82 serves as a ball seat for ball 84 (see FIG. 2*a*) to facilitate hydraulic release, as will be explained below. Passage 86 communicates with a frangible member, such as a rupture disk 88, to facilitate the ability to pump down ball 84 in certain conditions when passage 18 becomes obstructed at a point below seat 82.

The operation of the tool will now be described. The tool including body 12 is run into packer sleeve 22, where chevron seals 24 seal up against seal bore 90. The collets 28, which are supported by surfaces 60 and 62, engage the top end 92 of packer sleeve 22. Setting down weight on top sub 10 shifts body 12 downwardly. There is relative movement between the sleeve 30 and the collet ring 42 as setdown weight is applied to top sub 10. The pin 46 traverses groove 44 from its top end 94 toward its bottom end 96, as can be best seen by comparing FIGS. 1*b* and 2*b*. Thus, when weight is set down on top sub 10, sleeve 30 moves in tandem with it, moving pin 46 in groove 44. The downward movement of body 12, with respect to the collets 28 abutting top end 92 of packer sleeve 22, holds the collet ring 42 in position until taper 68 is present adjacent collets 28. This relative movement between body 12, taking with it sleeve 30 and collet ring 42, causes a compression of spring 38, as shown by a comparison of FIGS. 1*b* and 2*b*. Ultimately, with the sleeve 58 contacting the upper end 92 of the packer sleeve 22, the collets 28 have presented themselves opposite groove 26 without support because taper 68 also opposes the collets 28 at this time. This position is illustrated in FIG. 2*b*. Once the collets 28 have jumped into juxtaposition adjacent groove 26, as shown in FIG. 2*b*, an upward force is applied to top sub 10 which brings up body 12 as well as sleeve 30. As shown in FIG. 3*b*, the collets 28 are then trapped within groove 26 due to surfaces 60 and 62 once again coming in contact with collets 28. The tool is now latched to the packer and the packer can be run and set in a conventional manner due to auxiliary equipment attached at threads 16 (not shown) in a known manner.

When it is desired to release from the packer which is not shown, there are several techniques available with the tool of the present invention to do this. One way to do it is to create sufficient flow through passage 18 through orifice ring 76 to create a backpressure on passage 54. If prior to creating this backpressure setdown weight is applied, the backpressure created in cavity 48, coupled with a setdown force on top sub 10, will draw up collet ring 42 against spring 38 to put the collets 28 in the position shown in FIG. 2*b* so that a pickup force on top sub 10, while flow continues through passage 18 and orifice 76 will result in a release from the packer sleeve 22.

If for any reason the flow release is inoperative or unavailable, such as, for example, a down-the-line pluggage or obstruction of flowpath 18, or leaking seals 50 or 52, pressure is applied to passage 18 which is communicated to the rupture disk 88 through passage 86. Once the rupture disk 88 breaks, flow can be reestablished and a ball such as 84 can be dropped onto taper 82. With ball 84 seated on taper 82, pressure can then be developed from the surface through passage 54 into cavity 48 so that a release is possible by a combination of applied pressure on seated ball 84 with an initial setdown force. This combination puts the collets in the position shown in FIG. 2*b*. Once sufficient pressure has been built up on ball 84 when seated against taper 82, a pickup force is applied to top sub 10 and the collets 28, having assumed the position shown in FIG. 2*b*, can be cleared of groove 26 for a disconnection.

Figure 4A:
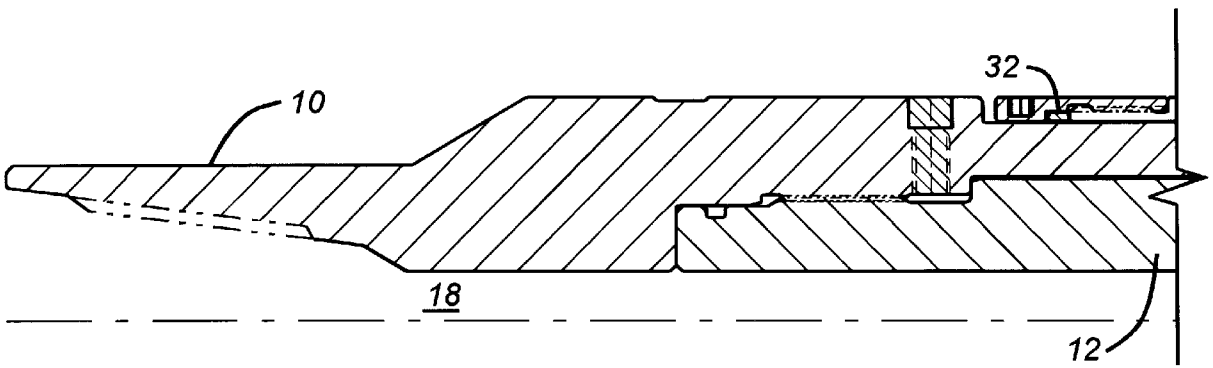
FIGS. 4*a–d* depict the same tool at the onset of the emergency shear release position.
Figure 4B:
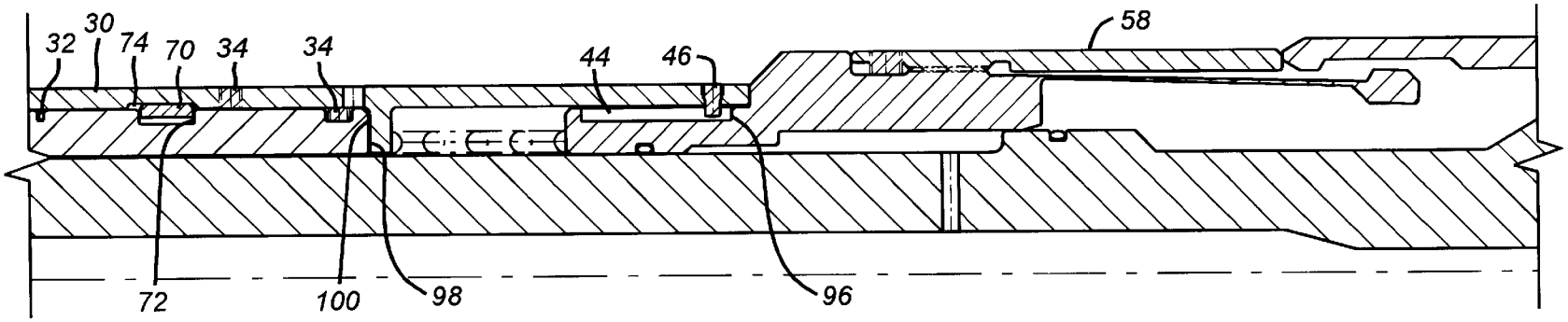
Figure 3C:
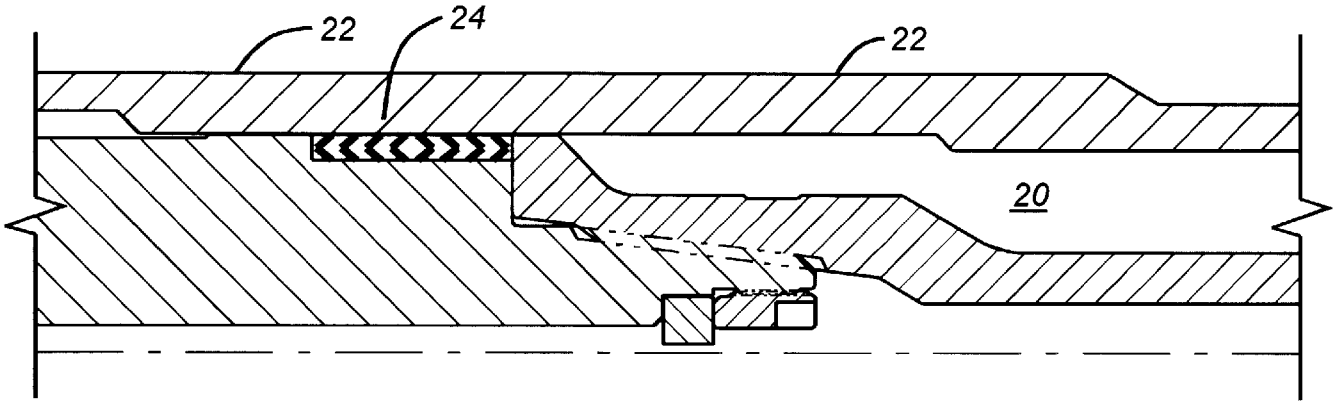
Figure 4C:
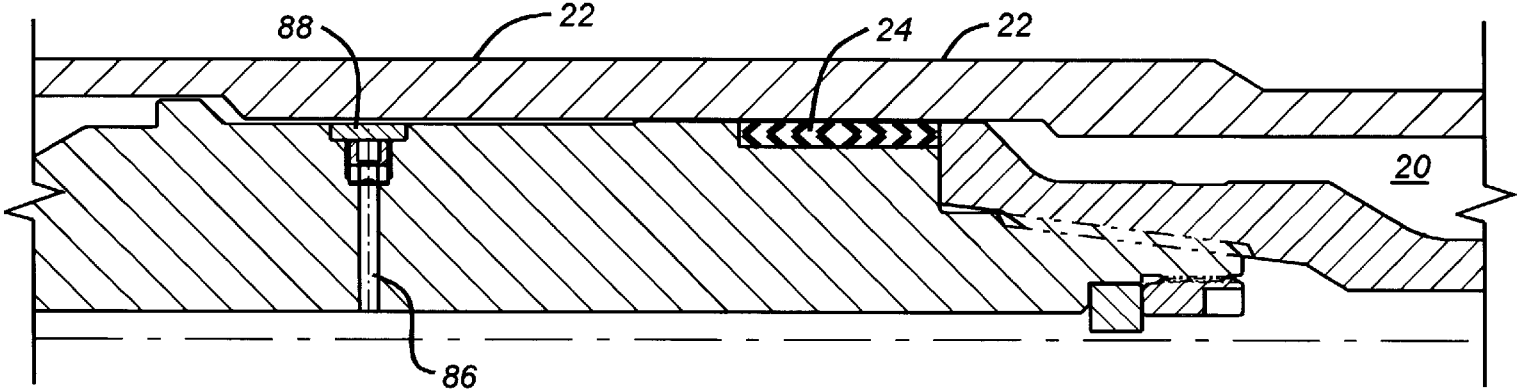
Figure 3D:
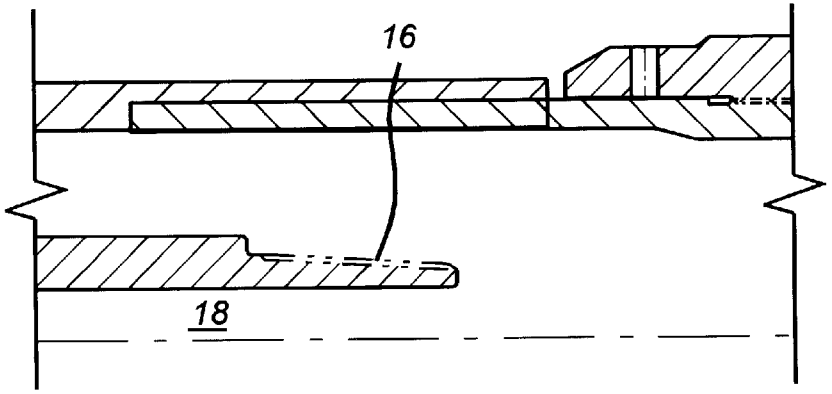
Figure 4D:
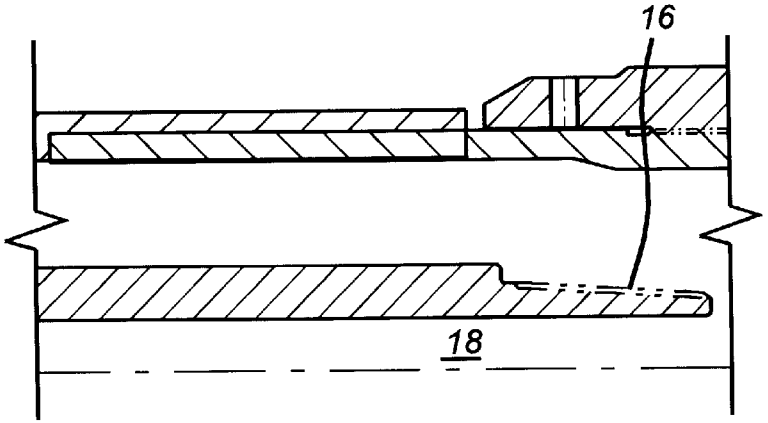
Figure 5A:
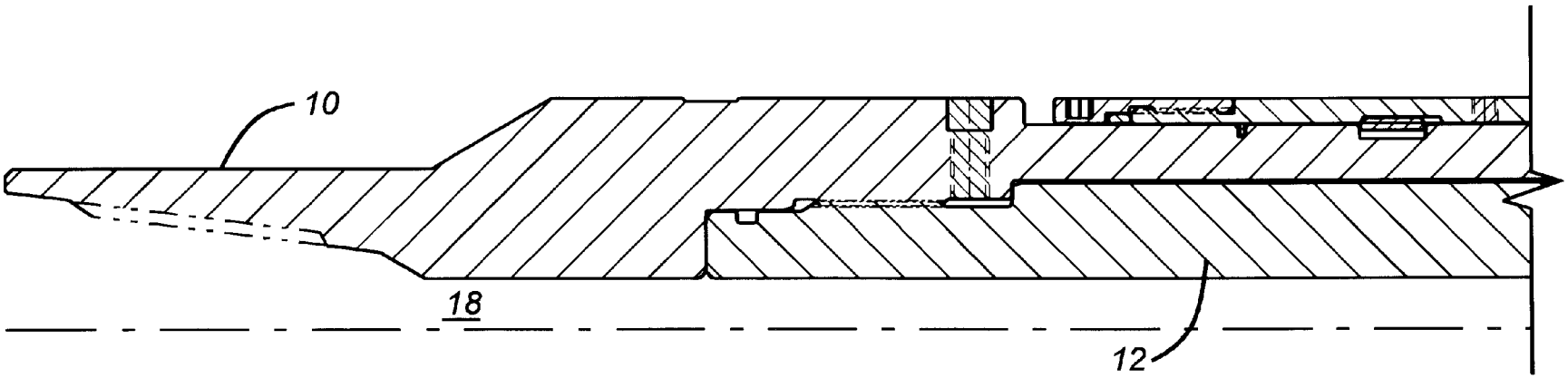
FIGS. 5*a–d* depict the same tool as an upward force is applied to conclude the emergency shear releasing of the tool.
Figure 5B:
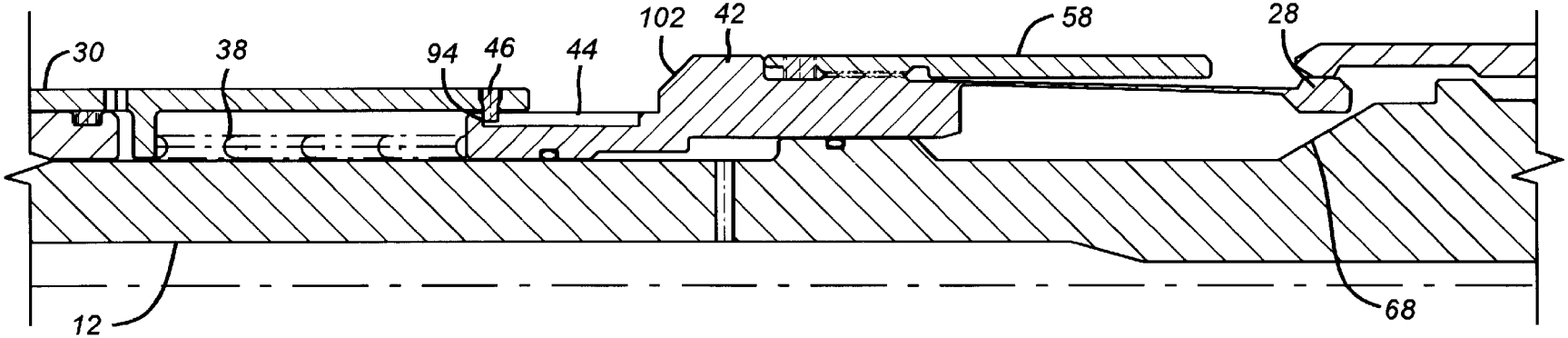
Figure 5C:
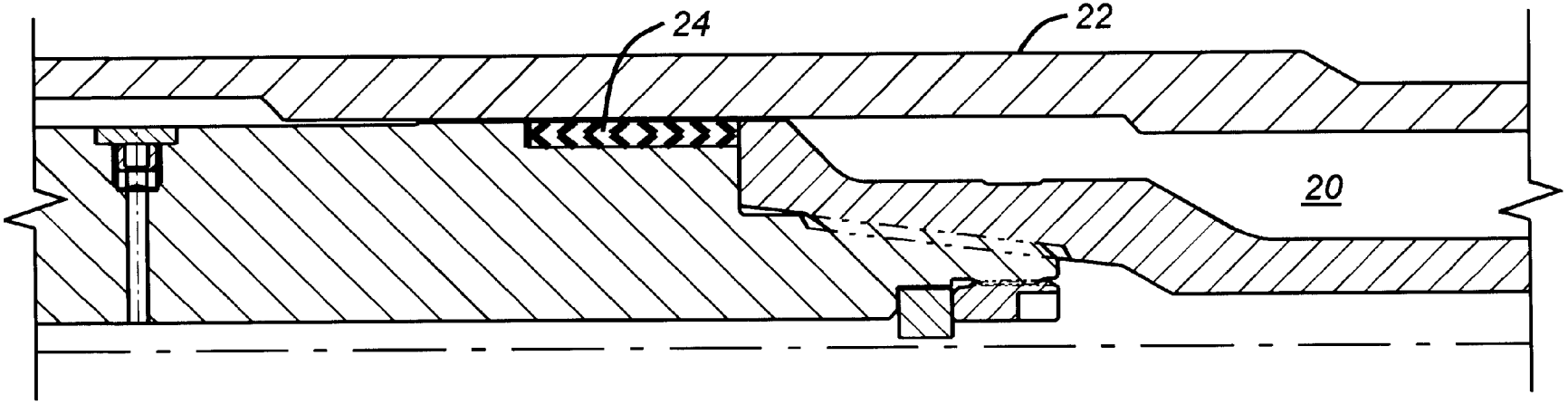
Figure 5D:
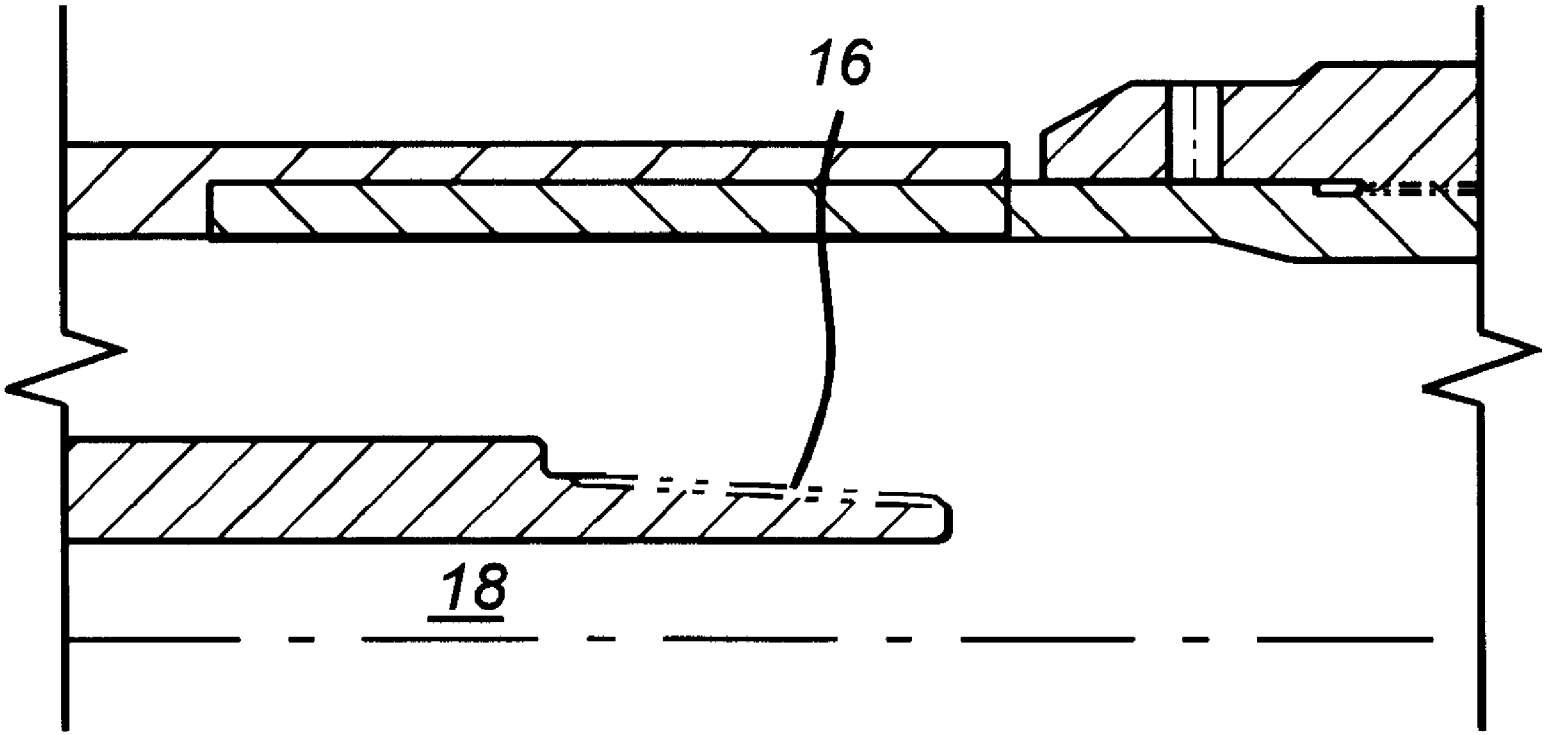

A third method of release is provided. If a setdown force on top sub 10 is applied beyond a predetermined amount, the shear ring 32 and shear pins 34 are all broken, as illustrated in FIGS. 4*a* and 4*b*. Accordingly, with the sleeve 58 in contact with upper end 92 of packer sleeve 22, a downward force applied to top sub 10 will cause top sub 10 to move relatively with respect to sleeve 30. Sleeve 30 has an internal radial surface 98 which acts as a travel stop for surface 100 at the bottom end of top sub 10. As seen by comparing FIGS. 1*b* and 4*b*, surfaces 98 and 100 approach each other after the shear ring 32 and shear pins 34 are broken. The lock ring 70 is translated by the movement of top sub 10 until it is brought into alignment with groove 74. The lock ring 70 has a tendency to expand if allowed and, when it is aligned with groove 74, partially expands into that groove so that it is partially into groove 74 and partially into groove 72, thus locking the sleeve 30 to top sub 10. FIG. 4*b* shows pin 46 adjacent the lower end 96 of groove 44, which is the position of the tool subsequent to the conclusion of the applied setdown force on top sub 10. Having broken the shear ring 32 and the shear pins 34 and latched lock ring 70 into grooves 72 and 74, a pickup force is applied to top sub 10, as illustrated in FIGS. 5*a* and 5*b*. Now the pin 46 moves toward the top end 94 of groove 44. Spring 38 has relaxed upon the application of the pickup force on top sub 10, as can be seen by comparing FIGS. 4*b* and 5*b*. Additionally, because the sleeve 30 is locked to top sub 10, when the pickup force is applied to top sub 10, there is tandem movement between body 12 and sleeve 30. At this time the collets 28 are juxtaposed against taper 68 to allow them to recede behind sleeve 58.

On the way out of the hole, there exists some possibility that the shoulder 102 could come into contact with a wellbore obstruction. The pickup shoulder 66 would engage shoulder 64 on the collet ring 42 to help the collet ring 42 get beyond the obstruction. Although an initial clearance is shown between the surfaces 64 and 66 in the run-in position, that clearance does not affect the ability of the collets 28 to seat in groove 26. However, one of the reasons for the provision of the support shoulder 66 is that prior designs have allowed the collets 28 on the trip out of the hole to occasionally become ensnared on wellbore obstructions, causing the collets 28 to fail as fingers 56 failed in shear. This design is intended to have the collets 28 in the position shown in FIG. 5*b* for removal such that it is unlikely that the collets 28 themselves would ever encounter a wellbore obstruction. Wellbore obstructions are most likely to come in contact with shoulder 102, in which case a more substantial support for the collet ring 42 is provided through the pickup shoulder 66 on body 12 so that the assembly can be advanced beyond the support without mechanical damage to the collets 28.

It should be noted that when the tool assumes the position shown in FIG. 4*b* and the lock ring 70 engages the groove 74, the collets 28 cannot re-engage groove 26 and be supported by surfaces 60 and 62. In essence, the lowermost reach of the collets 28 is illustrated in FIG. 5*b*.

The advantages provided by the tool of the present invention, as described above, include the ability to latch onto or off the fishing neck, such as 26, as many times as required using flow or pressure increase in the tool. This tool accommodates flow-thru unlike wireline tools, which do not have flow-thru capability. This tool provides a way to create a flowpassage should the tubing become obstructed for any reason, to facilitate the pumping of a ball to a seat to effectuate release. By virtue of design of the collets 28, this tool has higher tensile ratings than prior tools that used collet designs. This tool facilitates a release by setdown. The amount of force can be adjusted by the design of shear rings or shear pins. This tool provides an unloading shoulder 66 which eliminates load transfer through the collet fingers 56 during retrieval, which has caused some prior designs to fail at that location when the collets of those designs become engaged on an obstruction downhole. An upset in the tubing can be one such obstruction. The tool of the present invention has a thread 16 which is useful for attaching setting subs, flow control equipment, etc. Once the tool is emergency shear released, it cannot relatch.

The foregoing disclosure and description of the invention are illustrative and explanatory thereof, and various changes in the size, shape and materials, as well as in the details of the illustrated construction, may be made without departing from the spirit of the invention.

We claim:

1. A running and setting tool for a downhole tool, comprising:

a body;

a latching mechanism to selectively retain said body to the downhole tool;

wherein said latching mechanism can be selectively defeated in a plurality of different ways;

said latching mechanism is defeated at least in part by the onset and maintenance of continuous flow through said body without removal of said flow.

2. The tool of claim 1, wherein:

said latching mechanism is defeated at least in part by a pressure of said pressure build-up in said body.

3. The tool of claim 1, further comprising:

a flowpath through said body;

a restriction in said flowpath operably connected to said latching mechanism so as to move said latching mechanism relative to said body responsive to a force generated by flow through said restriction, whereupon said latching mechanism is defeated.

4. The tool of claim 1, wherein:

said latching mechanism comprises a plurality of radially movable locking members which, when supported by said body, retain the downhole tool;

said body configured to move relative to said locking members on application of a predetermined force;

said predetermined force overcoming a breakable member which allows relative movement of said body relative to said locking members;

said locking members, when unsupported due to breakage of said breakable member, are prevented from again being supported by said body.

5. The tool of claim 4, wherein:

said locking members become locked to said body in an unsupported position after application of a force to said body breaks the breakable member and creates said relative movement.

6. The tool of claim 4, wherein:

said body limits the movement of said locking members so as to protect them from engaging obstructions in the path of said body as it is being removed after release from the downhole tool.

7. A running and setting tool for a downhole tool, comprising:

a body;

a latching mechanism to selectively retain said body to the downhole tool;

wherein said latching mechanism can be selectively defeated in a plurality of different ways;

said latching mechanism is defeated at least in part by continuous flow through said body;

said latching mechanism is defeated at least in part by a pressure build-up, without removal of said pressure build-up in said body;

said latching mechanism is defeated apart from said pressure build-up by an applied mechanical force to said body above a predetermined value.

8. A running and setting tool for a downhole tool, comprising:

a body;

a latching mechanism to selectively retain said body to the downhole tool;

wherein said latching mechanism can be selectively defeated in a plurality of different ways;

a flowpath through said body;

a restriction in said flowpath operably connected to said latching mechanism so as to move said latching mechanism relative to said body responsive to a force generated by flow through said restriction, whereupon said latching mechanism is defeated;

a lateral passage extending through said body and in flow communication with said flowpath;

a breakable member obstructing said lateral passage;

whereupon if flow through said flowpath cannot be established to a sufficient level to defeat said latching mechanism, said breakable member is broken to allow flow through said body to facilitate defeat of said latching mechanism without use of said restriction.

9. The tool of claim 8, wherein:

said flowpath comprises a seat;

said lateral passage, when opened, facilitates flowing an obstruction onto said seat which isolates said lateral passage to allow pressure build-up in said flowpath of said body and against the obstruction to defeat said latching assembly.

10. A running and setting tool for a downhole tool, comprising:

a body;

a latching mechanism to selectively retain said body to the downhole tool;

wherein said latching mechanism can be selectively defeated in a plurality of different ways;

said latching mechanism is defeated at least in part by flow through said body;

said latching mechanism is defeated at least in part by a pressure build-up in said body;

said latching mechanism is defeated at least in part by an applied force to said body above a predetermined value;

a flowpath through said body;

a restriction in said flowpath operably connected to said latching mechanism so as to move said latching mechanism relative to said body responsive to a force generated by flow through said restriction, whereupon said latching mechanism is defeated;

a lateral passage extending through said body and in flow communication with said flowpath;

a breakable member obstructing said lateral passage;

whereupon if flow through said flowpath cannot be established to a sufficient level to defeat said latching mechanism, said breakable member is broken to allow flow through said body to facilitate defeat of said latching mechanism without use of said restriction.

11. The tool of claim 10, wherein:

said flowpath comprises a seat;

said lateral passage, when opened, facilitates flowing an obstruction onto said seat which isolates said lateral passage to allow pressure build-up in said flowpath of said body and against the obstruction to defeat said latching assembly.

12. The tool of claim 11, wherein:

said body defines a chamber formed with said latching mechanism, said latching mechanism can move with respect to said body, said chamber in fluid communication with said flowpath adjacent said seat;

whereupon when said seat is covered by an object inserted into said body, pressure build-up from said flowpath and into said chamber causes relative movement which defeats said latching mechanism by positioning a portion of the body opposite said latching mechanism to allow said latching mechanism to be deflected toward said body and away from engagement with the downhole tool.

13. The tool of claim 12, wherein:

said latching mechanism comprises a plurality of radially movable locking members which, when supported by said body, retain the downhole tool;

said body configured to move relative to said locking members on application of a predetermined force;

said predetermined force overcoming a breakable member which allows relative movement of said body relative to said locking members;

said locking members, when unsupported due to breakage of said breakable member and said relative movement, are prevented from again being supported by said body.

14. The tool of claim 13, wherein:

said locking members are biased from said body and their relative movement defined by a pin-in-slot combination with said body;

whereupon breakage of said breakable member, portions of said body move with respect to one another and their new position is held by a retainer, with the result being a new position of said slot which, at the end of travel of said pin in said slot, will not permit said body to support said locking members.

15. The tool of claim 13, wherein:

said body limits the movement of said locking members so as to protect them from engaging obstructions in the path of said body as it is being removed after release from the downhole tool.

16. A running and setting tool for a downhole tool, comprising:

a body;

a latching mechanism to selectively retain said body to the downhole tool;

wherein said latching mechanism can be selectively defeated in a plurality of different ways;

said latching mechanism comprises a plurality of radially movable locking members which, when supported by said body, retain the downhole tool;

said body configured to move relative to said locking members on application of a predetermined force;

said predetermined force overcoming a breakable member which allows relative movement of said body relative to said locking members;

said locking members, when unsupported due to breakage of said breakable member, are prevented from again being supported by said body;

said locking members become locked to said body in an unsupported position after application of a force to said body breaks the breakable member and creates said relative movement;

said locking members are biased from said body and their relative movement defined by a pin-in-slot combination with said body;

whereupon breakage of said breakable member, portions of said body move with respect to one another and their new position is held by a retainer, with the result being a new position of said slot which, at the end of travel of said pin in said slot, will not permit said body to support said locking members.

17. A running and setting tool for a downhole tool, comprising:

a body;

a latching mechanism to selectively retain said body to the downhole tool;

wherein said latching mechanism can be selectively defeated in a plurality of different ways;

a flowpath through said body;

a lateral passage extending through said body and in flow communication with said flowpath;

a breakable member obstructing said lateral passage;

whereupon if flow through said flowpath cannot be established to a sufficient level to defeat said latching mechanism, said breakable member is broken to allow flow through said body to facilitate defeat of said latching mechanism without use of said restriction.

* * * * *